US006709296B2

(12) United States Patent
Shiroyama et al.

(10) Patent No.: US 6,709,296 B2
(45) Date of Patent: Mar. 23, 2004

(54) MODULAR CONNECTOR ASSEMBLY

(75) Inventors: Kouichi Shiroyama, Tokyo (JP); Toshihiro Ichihashi, Tokyo (JP); Katsuhiko Namiki, Tokyo (JP); Yoshimasa Ito, Tokyo (JP); Hiroshi Sakata, Tokyo (JP); Eiichiro Takemasa, Kanagawa (JP)

(73) Assignees: Advantest Corporation, Tokyo (JP); Tyco Electronics AMP K.K., Kanagawa (JP)

( * ) Notice: Subject to any disclaimer, the term of this patent is extended or adjusted under 35 U.S.C. 154(b) by 0 days.

(21) Appl. No.: 10/155,318

(22) Filed: May 24, 2002

(65) Prior Publication Data

US 2002/0142662 A1 Oct. 3, 2002

Related U.S. Application Data

(63) Continuation of application No. PCT/JP00/03330, filed on May 24, 2000.

(30) Foreign Application Priority Data

Nov. 26, 1999 (JP) ..... H11-336776

(51) Int. Cl.[7] ..... H01R 6/37
(52) U.S. Cl. ..... 439/637
(58) Field of Search ..... 436/637, 630, 436/60, 924.1, 65, 74, 79, 676, 344

(56) References Cited

U.S. PATENT DOCUMENTS

| | | | | |
|---|---|---|---|---|
| 4,134,632 A | * | 1/1979 | Lindberg et al. | 439/79 |
| 4,824,383 A | | 4/1989 | Lemke | 439/108 |
| 4,871,321 A | * | 10/1989 | Johnson | 439/79 |
| 4,952,172 A | * | 8/1990 | Barkus et al. | 439/532 |
| 5,013,263 A | | 5/1991 | Gordon et al. | 439/630 |
| 5,024,609 A | | 6/1991 | Piorunneck | 439/637 |

FOREIGN PATENT DOCUMENTS

| | | | |
|---|---|---|---|
| JP | 51-19587 | 6/1976 | |
| JP | 55-4941 | 2/1980 | |
| JP | 63-98985 | 4/1988 | ..... H01R/13/502 |
| JP | 2-7884 | 1/1990 | |
| JP | 2-89788 | 7/1990 | |
| JP | 3-233879 | 10/1991 | |
| JP | 3-295181 | 12/1991 | |
| JP | 2502160 | 4/1996 | |
| JP | 8-255661 | 10/1996 | |
| JP | 11-3753 | 1/1999 | |
| WO | WO 01/39333 A1 | 5/2001 | |

OTHER PUBLICATIONS

PCT International Search Report, Sep. 5, 2000, 4 pages.

* cited by examiner

*Primary Examiner*—Tulsidas C. Patel
(74) *Attorney, Agent, or Firm*—Rosenthal & Osha L.L.P.

(57) ABSTRACT

The module-type connector according to the present invention defines the connectable connectors with a rigid supporting plate which extends along the connecting direction in order to make it easy to properly fit a male connector to a female connector. In the module-type connector, the contacting portions of the contacts that are shifted in the separation direction of the corresponding terminal with which the contacting portions contact are almost uniformly distributed. Further, the male connector that receives a preliminary load from different levels in the direction so that opposing elastic contacting portions are widened by engaging between the first end portion of each contact within a housing and the different levels of the housing, has at least a protruding portion that protrudes from the contacting surface of the plurality of contacts toward the contacting surface thereof and that is provided between contacts.

12 Claims, 15 Drawing Sheets

MODULAR CONNECTOR ASSEMBLY

This is a continuation application of PCT/JP00/03330 filed on May 24, 2000, further of a Japanese patent application, H11-336776 filed on Nov. 26, 1999, the contents of which are incorporated herein by reference.

BACKGROUND OF THE INVENTION

1. Field of the Invention

The present invention relates to a connector. In particular, the present invention is directed to a female connector and a male connector that can reduce inserting and separating forces and apply sufficient contacting force to contacting elements.

2. Description of the Related Art

Generally, an electrical device has a circuit board, cables and so forth which are arranged therein and are electrically connected to one another. In order to electrically connect the circuit boards to one another, or in order to connect the circuit boards with a plurality of conductors such as cables, an electrical connector is usually used. Generally, the electrical connector is comprised of a female connector (receptacle connector) and a male connector (plug connector) so that it is possible to fit and separate each other. The female connector has a plurality of female contacts made of elastic material within an insulating housing as a module-type connector; the male connector has a plurality of contacts that are arranged in both sides of the walls of the male portions. Generally, when these connectors are fitted with each other or separated with respect to each other, the contacts of the connectors are connected by fitting to each other. With the fitting connection, the conductors can be electrically connected or disconnected to one another. For example, the connectors are fitted to each other when the device using the connectors are assembled and is separated at necessary times for maintenance service and so forth.

This connector generally has insulating housing and one or more contacts. As the number of contacts of the connector increases, a large force is necessary for fitting or separating both connectors. Particularly, the force necessary for fitting them, that is, the insertion force is greater than the force necessary for separating them. Further, when a female connector and a male connector are fitted to each other, friction must occur. The friction causes cutting of the walls of the male portion of the male connector and the debris caused due to cutting enters the contacting portion between the contacts, thereby causing poor contact.

Further, the number of necessary contacts has recently tended to increase. The increase in the number of contacts requires the connector to have more contacts than the conventional connector. The necessity has been satisfied by providing connector assembly by serially joining a plurality of the same module-type connectors having a predetermined number of contacts along the arranging direction (referred to as "lengthwise direction" hereinafter).

The electrical device that has a tendency that the number of necessary contacts increases employs the technique where many connector assemblies are arranged in a crosswise direction, thereby connecting many conductors to one another. In the technique, since many connectors should be inserted or separated at the same time, low insertion force becomes important and female and male connectors may collide with each other or wrong connectors may be fitted with each other.

The recent tendency has been that as the number of necessary contacts increases, it has become necessary to accurately position the contacting portions in the module-type connector having a plurality of connecting connectors. Further, as the number of connecting connectors increases, sufficient mechanical strength is required.

Further, since the recently developed connector requires more contacts than the conventional connector, the connector with lower insertion force than the conventional connector is required. In this regard, zero input force fitting disclosed by Utility Model Publication (Kokai) No. Sho 59-110990 or low input force fitting disclosed by Utility Model Publication (Kokai) No. Hei 5-57785 can be used. The latter technique has a simple structure and is easy to manufacture. Further, according to Utility Model Publication (Kokai) No. Hei 5-57785, an additional member is inserted between the contacts of a female connector and a preliminary load is applied so that the gap between the opposing contacts grows, thereby reducing the insertion force necessary for starting the fitting male connector to female connector. However, this technique requires some elements referred to as the additional member. Further, since if many connector assemblies are arranged in the crosswise direction to be connected to one another, the insertion and separation of the many connectors should be conducted at the same time, reducing insertion force is important and it is necessary to prevent a female connector from colliding and from being fitted in a wrong connector.

SUMMARY OF THE INVENTION

Therefore, it is an object of the present invention to provide a connector which overcomes the above issues in the related art. This object is achieved by combinations described in the independent claims. The dependent claims define further advantageous and exemplary combinations of the present invention.

According to the first aspect of the present invention, a module-type connector comprising: a plurality of connectors which have a plurality of contacts having contacting portions contacting with a corresponding terminal and a housing which holds said plurality of contacts; and a rigid supporting plate on which each of said connectors is fixed.

The plurality of contacts may be serially arranged in a lengthwise direction of the contacts and are fixed on said rigid supporting plate.

The module-type connector may further comprise a plurality of the rigid supporting plates which fix the plurality of connectors by interposing each of the plurality of connectors therebetween.

Each of said connectors may have a fastener defining position of said plurality of connectors with respect to said rigid supporting plates by fastening said rigid supporting plate with the plurality of connectors.

At least one of said plurality of connectors may have a protruding portion at an end in the lengthwise direction; wherein at least another one of said plurality of connectors may have a recess portion at an end in the lengthwise direction; wherein the plurality of connectors may be fixed by interposing a fitting portion, where said protruding portion and said recess portion may be fitted to each other, between the plurality of rigid supporting plates and by said fastener penetrating the rigid supporting plate and the fitting portion and fastening the rigid supporting plate and the fitting portion.

The rigid supporting plate has a groove or opening in a predetermined position and the plurality of connectors may have protrusions and where in the position of the plurality of connectors with respect to the rigid supporting plate may be defined by fitting the protrusion to the groove or the opening.

The rigid supporting plate may have a form of box, and wherein the position of the plurality of connectors with respect to the rigid supporting plate may be defined by having the plurality of connectors received therein.

According to the second aspect of the present invention, a connector having a plurality of contacts, each of which has a contacting portion contacting with a corresponding terminal and a first end portion, wherein the contacting portions of the plurality of contacts are shifted in the insertion direction of the corresponding terminals.

Each contact may have a second end portion that is provided in the opposing side of the first end portion and a second contacting portion that is provided in the side of the second end portion, and wherein the second contacting portions of the plurality of contacts may be shifted in the insertion direction of the corresponding terminal.

The plurality of second end portions may be shifted in the insertion direction of the corresponding terminals, and wherein the difference in the insertion direction between the level of the first end portion of a predetermined contact and the level of the first end portion of the contact adjacent to the predetermined contact may be substantially the same as the difference between the level of the second end portion of the predetermined contact and the level of the second end portion of the contact adjacent to the predetermined contact in the insertion direction.

The plurality of contacts may be disposed so as to oppose one another, and wherein the connector may further have a housing having an engagement portion that engages the first end portion of each of the contacts in the different position with respect to the insertion direction of the corresponding terminal in order to widen the gap between the contacting portions of the plurality of contacts which oppose one another.

According to the third aspect of the present invention, a connector having a plurality of contact shaving contacting portions contacting with corresponding terminals and being opposed to each other, said connector having housing having an engagement portion which engages with an end portion of each said contact in order to widen the gap between the contacting portions of the plurality of opposing contacts.

The contacting portions of the plurality of contacts may be shifted in the insertion direction of the corresponding terminals.

According to the fourth aspect of the present invention, a connector comprising a plurality of contacts having contacting portions contacting with corresponding terminals and a supporting member supporting the plurality of contacts, the connector further comprises a protruding portion that is provided between a predetermined contact of the plurality of contacts and the contact adjacent to the predetermined contact and that protrudes from contacting surface of the plurality of contacts and the corresponding terminals.

The protruding portion may be made of the same material as the housing holding the corresponding terminal or may be made of material which is softer than the housing.

The protruding portion may be integrally formed with the supporting member.

The gap between the plurality of contacts and the supporting member may exist in the cross-sectional view of the perpendicular direction to the arranging direction of the plurality of contacts.

The plurality of contacts may be arranged back to back each other at both sides of the supporting member and wherein each of the contacts may bend toward the supporting member as it goes along the insertion direction of the connector.

According to the fifth aspect of the present invention, a connector comprising a plurality of contacts having contacting portions contacting with corresponding terminals and a supporting member supporting the plurality of contacts, the connector further comprises a protruding portion that is provided between a predetermined contact of the plurality of contacts and the contact adjacent to the predetermined contact and that protrudes from contacting surface of the plurality of contacts and the corresponding terminal, and wherein a gap exists between the plurality of contacts and the supporting member, the gap exists from an end to the other end of the width direction of the plurality of contacts.

The plurality of contacts may be arranged back to back each other at both sides of the supporting member and wherein each of the contacts may bend toward the supporting members as it goes along the insertion direction of the connector.

This summary of the invention does not necessarily describe all necessary features so that the invention may also be a sub-combination of these described features.

DETAILED DESCRIPTION OF THE INVENTION

The invention will now be described based on the preferred embodiments, which do not intend to limit the scope of the present invention, but exemplify the invention. All of the features and the combinations thereof described in the embodiment are not necessarily essential to the invention.

Figure 1:
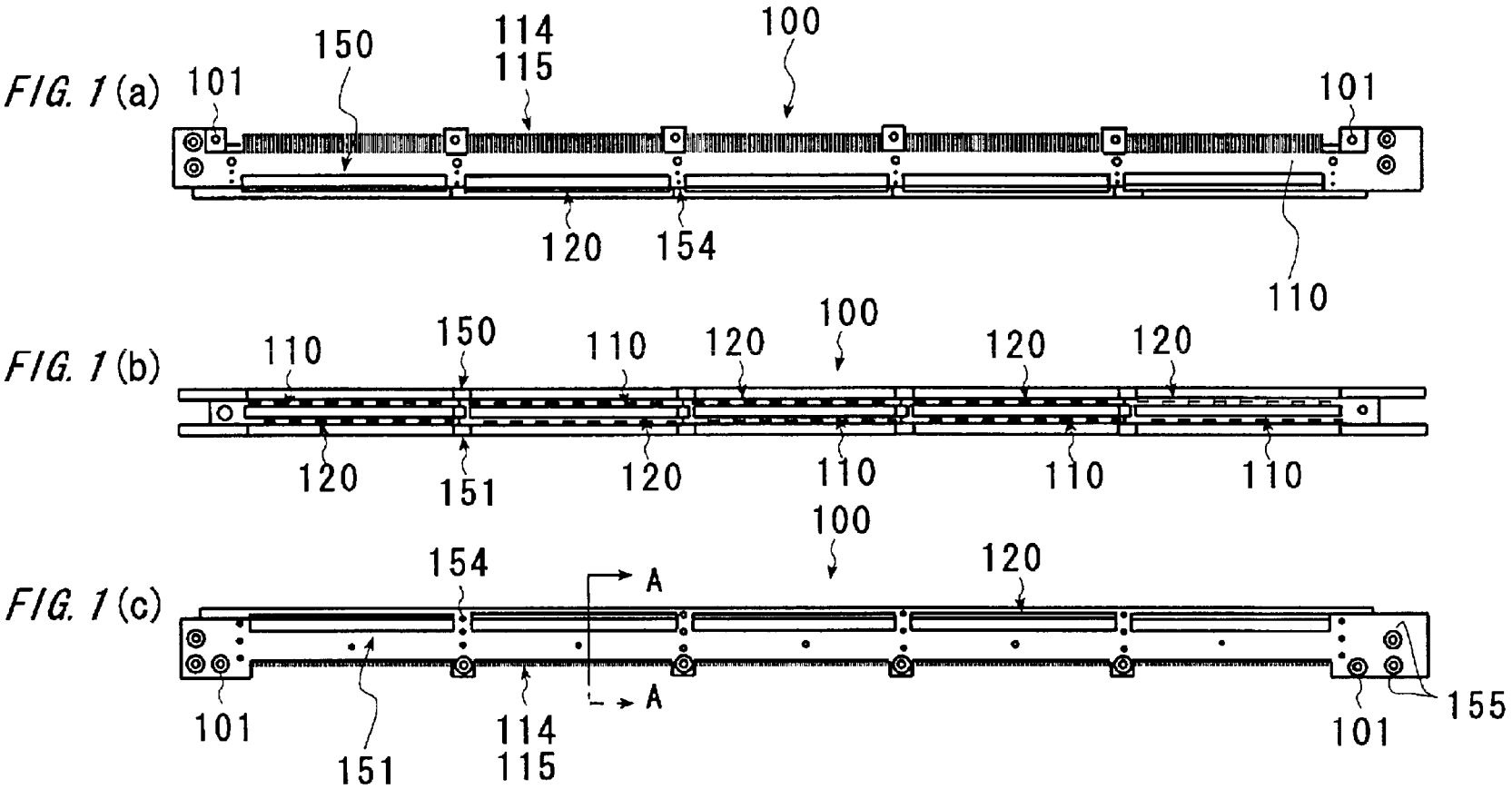
FIGS. 1(*a*)–(*c*) shows the module-type connector of the present invention wherein 1(*a*) is a plan view, 1(*b*) is a front view, and 1(*c*) is a bottom view.
Figures 2A, 2B:
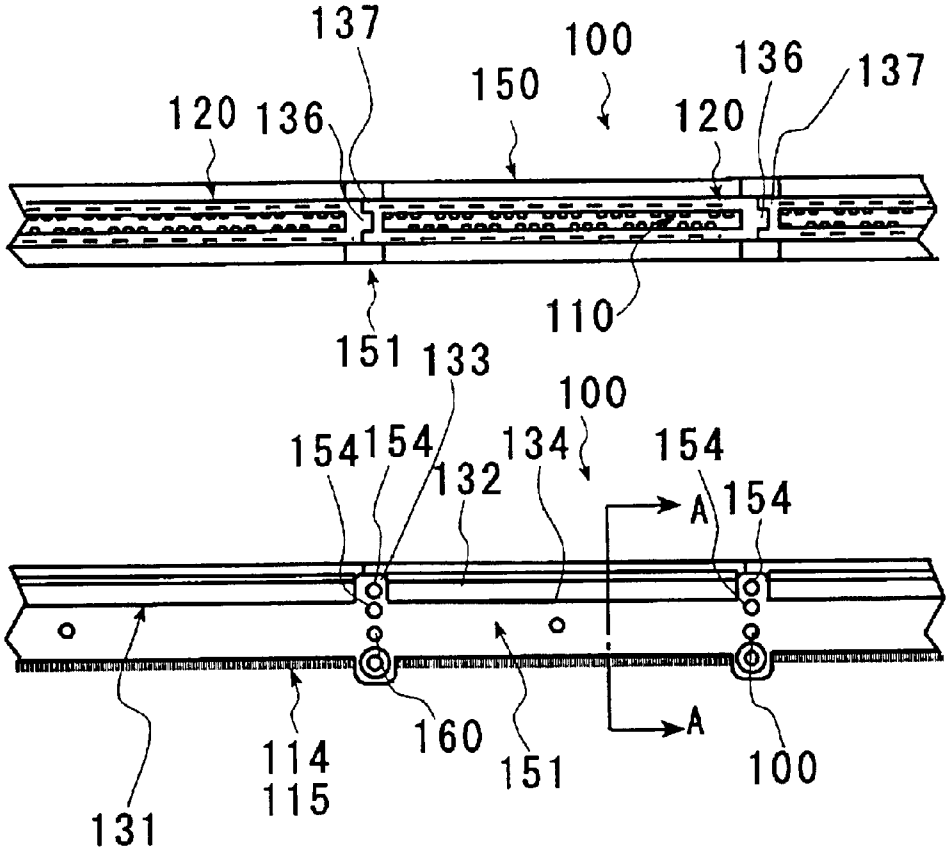
FIG. 2 shows an enlarged portion of the connector assembly of FIG. 1 wherein 1(*a*) is an enlarged plan view and 1(*b*) is an enlarged front view.
Figure 3:
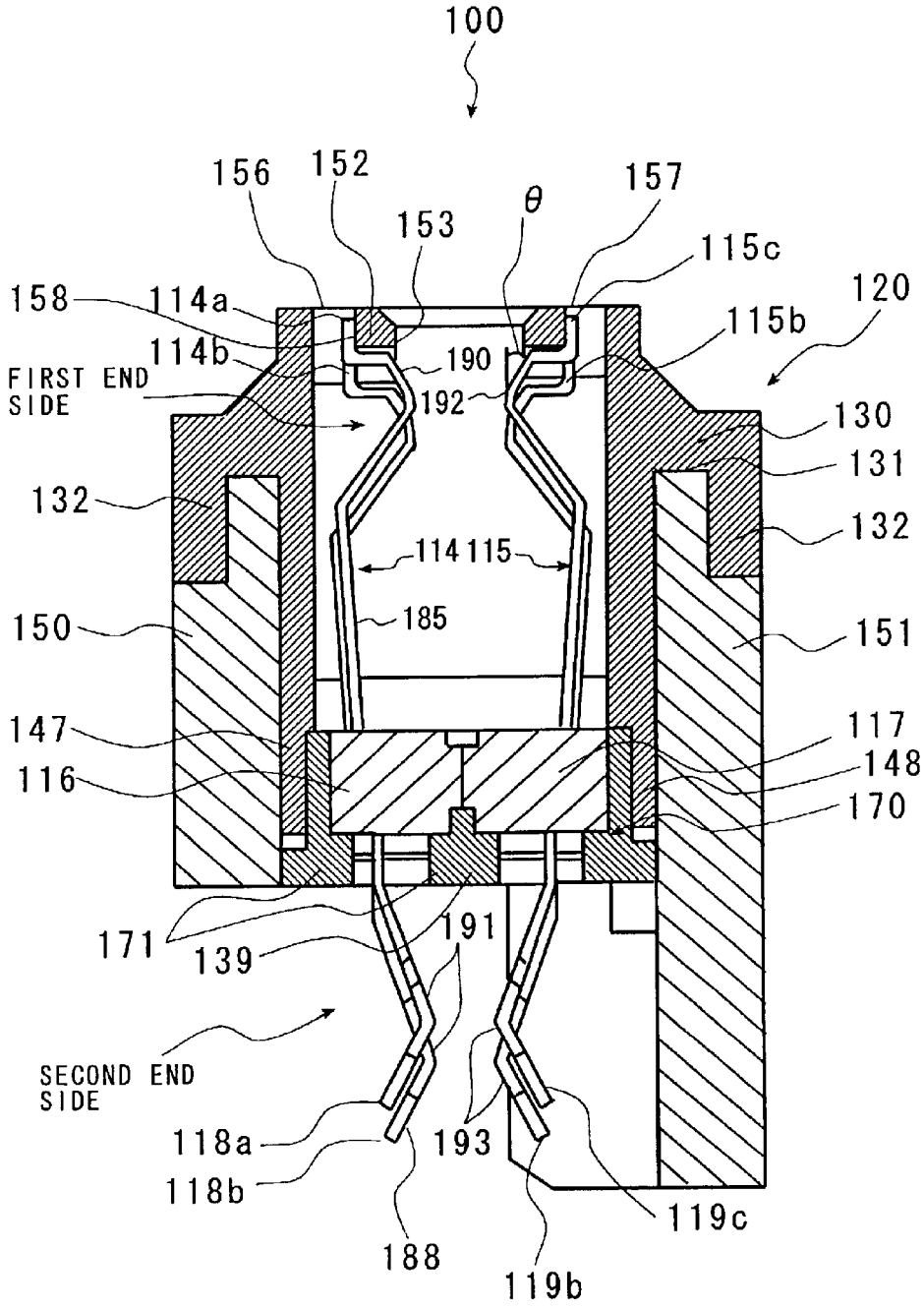
FIG. 3 is a cross-sectional view of FIG. 1 or FIG. 2 along line A—A.

FIG. 1 shows a module-type connector according to the present embodiment. FIGS. 1*a* and 1*c* are side views of the module-type connector and FIG. 1*b* is a plan view of the connector. FIG. 2 is a partially enlarged view of the connector assembly of FIG. 1. FIG. 2*a* is an enlarged plan view and FIG. 2*b* is an enlarged side view. FIG. 3 is a cross-sectional view of FIGS. 1 and 2 along lines A—A.

FIG. 1 shows module-type connector (100). In module-type connector (100) of the present embodiment, a plurality of housings (120) that have the contacting portions of contacts (114, 115) therein are longitudinally connected to one another, and are fixed so that both sides of the housings are interposed between rigid supporting plates (150, 151). Contacts (114, 115) of one side of the terminals (referred to as "the first end side," hereinafter) collectively connect to a plurality of contacting portions that are arranged in the male connector (shown in FIG. 10) and are secured, and the other side of the terminals (referred to as "the second end side," hereinafter) collectively connects to a plurality of contacting portions that are longitudinally arranged in a circuit board (not illustrated) and are secured. Further, the male connector electrically connects to another circuit board (for example, motherboard and so forth). Therefore, the circuit board and the other circuit board can be electrically connected to each other by the male connector and the module-type connector (100).

In the present embodiment, five housings (120) are joined along the lengthwise direction of module-type connector (100). In each housing (120), contacts (114, 115) are disposed and connector structure (110) is formed. Five housings (120) are mechanically joined to one another at their ends, and are fixed so that the sides of the housings are interposed between long and slender rigid supporting plates (150, 151). Specifically, screws that are received in hole (154) and opening (155) press housing (120) so that both sides of the housing are opposed to each other and thereafter, secure housings (120). Further, contacts (114, 115) are relatively fixed with respect to rigid supporting plates (150, 151).

FIG. 2 shows an enlarged module-type connector (100). As seen from the top side, housing (120) has engagement ends (136, 137) that are formed so as to be engaged with each other, and rigid supporting plates (150, 151) that are disposed along the sides of the housing. In the figure, engagement end (136) is a rectangular protrusion and the protrusion does not have any constriction. However, in another embodiment, the width of the base of engagement end (136) can be smaller than the width of the middle portion of engagement end (136) so that engagement end (136) has constriction. In this embodiment, engagement end (136) can have a form of inflated sphere. Further, it is possible that engagement end (136) is a form of trapezoid wherein the width of the base of the engagement end is smaller than that of the leading end. In these embodiments, it is preferred that engagement end (137) has a form of complementary recessed sphere or trapezoid to engage with engagement end (136).

Hole (160) of rigid supporting plates (150, 151) receives a protrusion (180) (See FIG. 5) of lateral sides of extension (172) of the first housing, thereby supporting housing (120) along the longitudinal direction of the connection. A projection (132) projects from housing (120) and is shaped so as to be fitted to rigid supporting plate (151). Projection (132) is fitted to rigid supporting plate (151) (See FIG. 3), and is received within a large receiving groove (134) that is formed from rigid supporting plate (151) between adjacent protrusions (133) in a lengthwise direction of rigid supporting plate (151). Since projection (132) is received in receiving groove (134), the lengthwise end surfaces of projection (132) make contact with the lateral surfaces of protrusion (133). Fitting projection (132) to rigid supporting plate (151) and making contact of the lengthwise end surfaces of projection (132) with the lateral surfaces of protrusion (133), define the relative position between rigid supporting plate (151) and housing (120).

Rigid supporting plates (150, 151) are fastened to housing (120) by a screw that is received in hole (154). Hole (154) exists in every engagement end, and the position of each housing (120) is defined by the screw that passes through the joining part.

FIG. 3 shows a cross-sectional view of module-type connector (100). Housing (120) comprises a first housing (170) which supports base components (116, 117) fixing middle portion of contacts (114, 115), and a second housing (130) which covers from the first end side of contacts (114, 115). Base components (116, 117), the first housing and the second housing are made of insulating material, for example, thermoplastic resin. Preferably, contacts (114, 115) have the same configuration. Further, contacts (114, 115) are comprised of end (158) of the first end side, the surface of which contacts with engagement small hole (156) with pressure faces insertion opening (153); contacting portion (190) that contacts the corresponding terminal and protrudes toward insertion opening (153); elastic portion (185) that elastically extends to base component (116) from contacting portion (190); through component (not illustrated) that is fixed in base component (116) and passes through base component (116); contacting portion (191) that protrudes from base component (116) extending toward the second end side so that contact (114) and contact (115) face toward each other, that is, so that the distance between the contacts decreases; and end portion (188) that folds from contacting portion (191) so that the distance between the contacts increases.

The second end side of contacts (114, 115), which is fixed in base components (116, 117) passes between frames (171) that is formed in first housing (170); base components (116, 117) are received within frame (171) and are held therein. Second housing (130) is covered in the first end side of contacts (114, 115) and is fitted to frame (171) of the first housing. Second housing (130) has projection (132) so that lengthwise fitting groove (131) is formed in the lateral sides thereof. A portion of rigid supporting plates (150, 151) is received in fitting groove (131) and this fitting corrects lengthwise distortion of a plurality of connecting housings (120). As shown in FIG. 1, contacts (114, 115) are fixed with respect to rigid supporting plates (150, 151) by screws that are received in hole (154) and opening (155).

As described in the above, housing (120) is, for example, made of insulating material such as thermoplastic resin. However, it is physically impossible to make a plurality of contacts with the same configuration and therefore, it is inevitable that errors occur. Further, the insulating material such as resin can transform according to the condition in which the contacts are used. In this circumstance, since the lengthwise errors of the contacting portions of housing assembly accumulate as the number of connecting connectors increases, poor contact and shorting are caused due to discrepancies of the position of contacting portions. The rigidity of module-type connector (100) increases in the opening direction of contacts (114, 115) when the corresponding male connector is inserted because rigid supporting plates (150, 151) fix module-type connector (100). Further, the accumulation of discrepancies of the lengthwise contacts is avoided and bad contact is prevented.

Generally, in order to improve the assembly operability of the connector, a low insertion force ("LIF") connector is indispensable. For multi-polarity fitting, zero insertion force ("ZIF") is also used. However, a low insertion force connector has a structure that is simpler and easier to manufacture.

On the other hand, even in the low insertion force connector, sufficient contacting force is necessary between contacting portions of both connectors in use. If contacting pressure is insufficient, bad contact is caused by more or less vibration impact or an oxide or other contaminants that are formed in the contact surface. Therefore, the fundamental function of the connector is not accomplished and the apparatus can be mal-operated or be out of order.

In the following, described is a module-type connector that is able to keep appropriate contacting pressure, does not require additional members, that sufficiently lowers insertion force, and is easy to assemble.

FIGS. 4 to 7 more specifically show housing (120) of the module-type connector, contacts (114, 115) and base components (116, 117).

Figure 4:
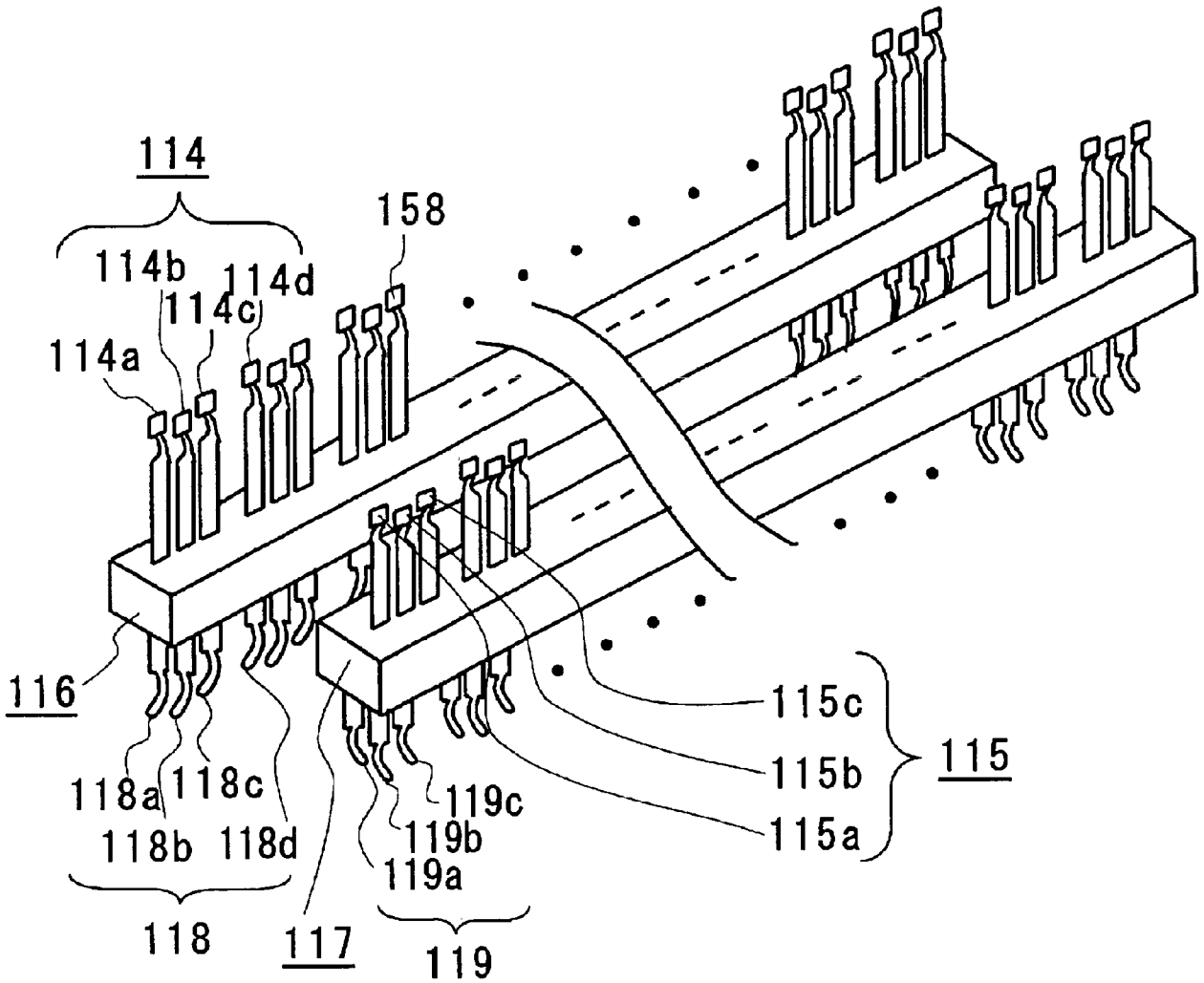
FIG. 4 is an enlarged perspective view of contacts and the base component of the module-type connector.

FIG. 4 is an enlarged perspective view of contacts (114, 115) and base components (116, 117). In two rectangular column-type base components (116, 117), contacts (114, 115) that have elastic material respectively are held in base components (116, 117) of resin material by an insert mold and are arranged in a lengthwise direction. In the present embodiment, contacts (114, 115) are assembled three by three as illustrated and are fixed in base components (116, 117).

Figure 5:
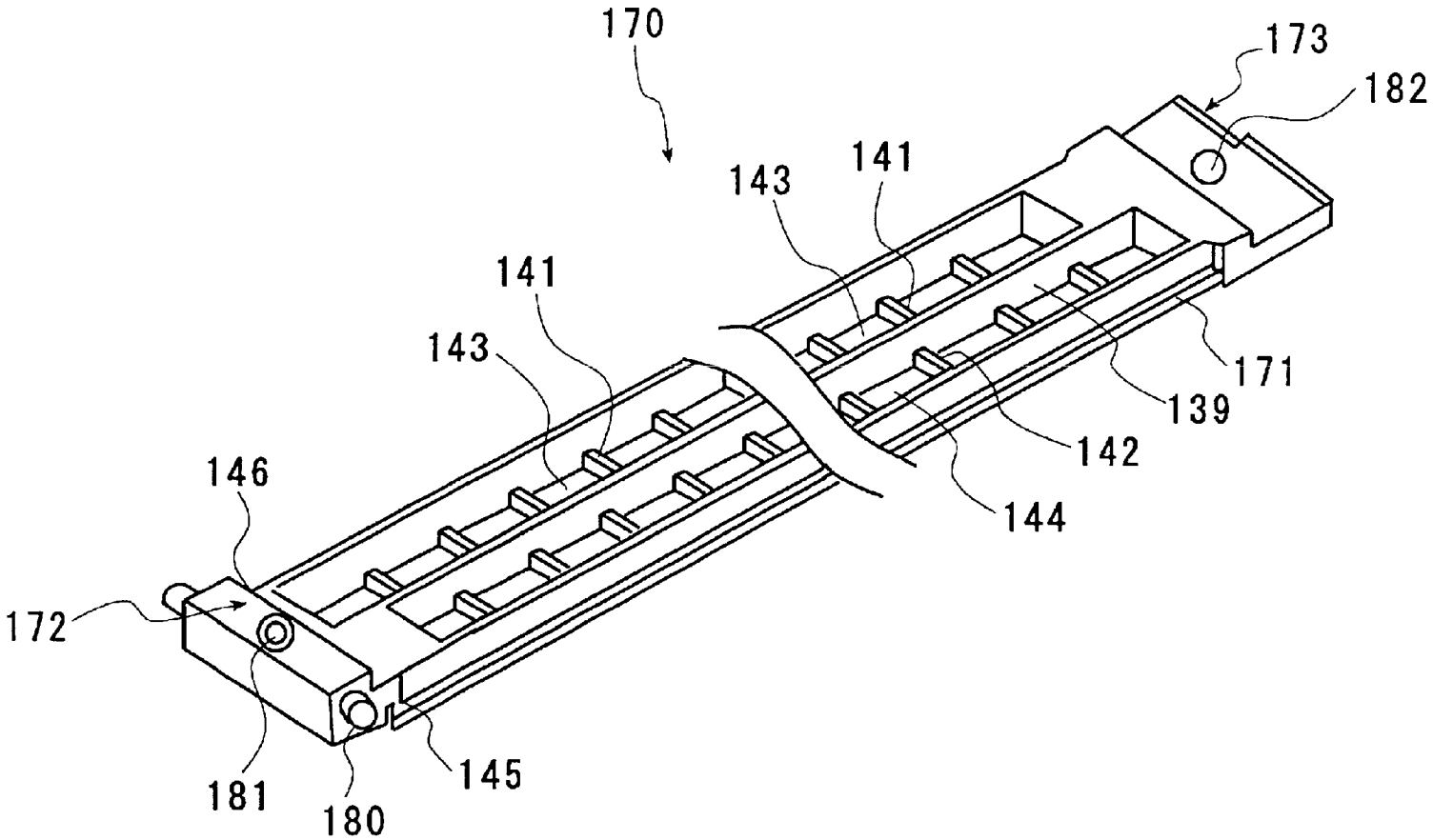
FIG. 5 is an enlarged perspective view of a first housing.

FIG. 5 is an enlarged perspective view of first housing (170). As shown in FIG. 3, the second end side of contacts (114, 115) is inserted into frame (171) of the first housing and is supported therein. As shown in FIG. 5, frame (171) is rectangular and includes lengthwise beam (139) in the center bottom, which longitudinally extends and cross beams (141, 142) having a predetermined interval therebetween in both sides of frame (171). Lengthwise beam (139) and cross beams (141, 142) are integrally formed with frame (171) as a mold of synthetic resin. Cross beams (141, 142) are shifted with respect to each other by a half of their pitch. According to FIG. 3, the first end side of contacts (114, 115) protrudes from base components (116, 117) and becomes the second side contacts (118, 119). The second side contacts (118, 119) are assembled three by three with contacts (114, 115) and protrude to the lower side of frame (171) through rectangular openings (143, 144) that are formed in lengthwise beam (139) and cross beams (141, 142). (In the following, the contacts of the second end side of contacts (114, 115) are referred to as contacts (118, 119), respectively, and the contacts of the first end side are referred to as contacts (114, 115), respectively.)

Further, extensions (172, 173) are provided in both ends of first housing (170). Extension (172) has protrusion (180) that protrudes from both sides of the extension and through-hole (181) that passes through in the height direction. Bottom of extension (172) is elevated in the height direction. On the other hand, extension (173) also has through-hole (182) in the height direction and has a nut receiving portion (not shown) that receives the nut member, which is formed in the back side thereof. The nut receiving portion is communication with through-hole (182) that passes through extension (173) in the height direction. The surface of extension (173) is formed as being lower than other surfaces of frame (171). When housing (120) is joined, adjacent first housings (170) are joined by mechanically connecting extensions (172, 173) to each other. That is, the bottom of extension (172) of the first housing is overlapped onto the surface of extension (173) of the other first housing. In this way, through-hole (181) of extension (172) of the first housing is communication with through-hole (182) of extension (173) of the other first housing. In communicating through-holes (181, 182), screws and nuts and so forth (not illustrated) are used to clamp extensions (172, 173) and fasten them. Thus, adjacent first housings (170) can be connected and fastened to each other.

Protrusion (180) that is provided in the sides of extension (172) of the first housing supports housing (120) along the lengthwise connecting direction and is received in hole (160) (See FIG. 2) of rigid supporting plates (150, 151). In this way, the relative position between housing (120) and rigid supporting plates (150) is accurately defined. Housing (120) can be fixed by conforming the dimension of protrusion (180) to that of hole (160) and by pressing it in a crosswise direction so as to be interposed between rigid supporting plates (150).

Figure 6:
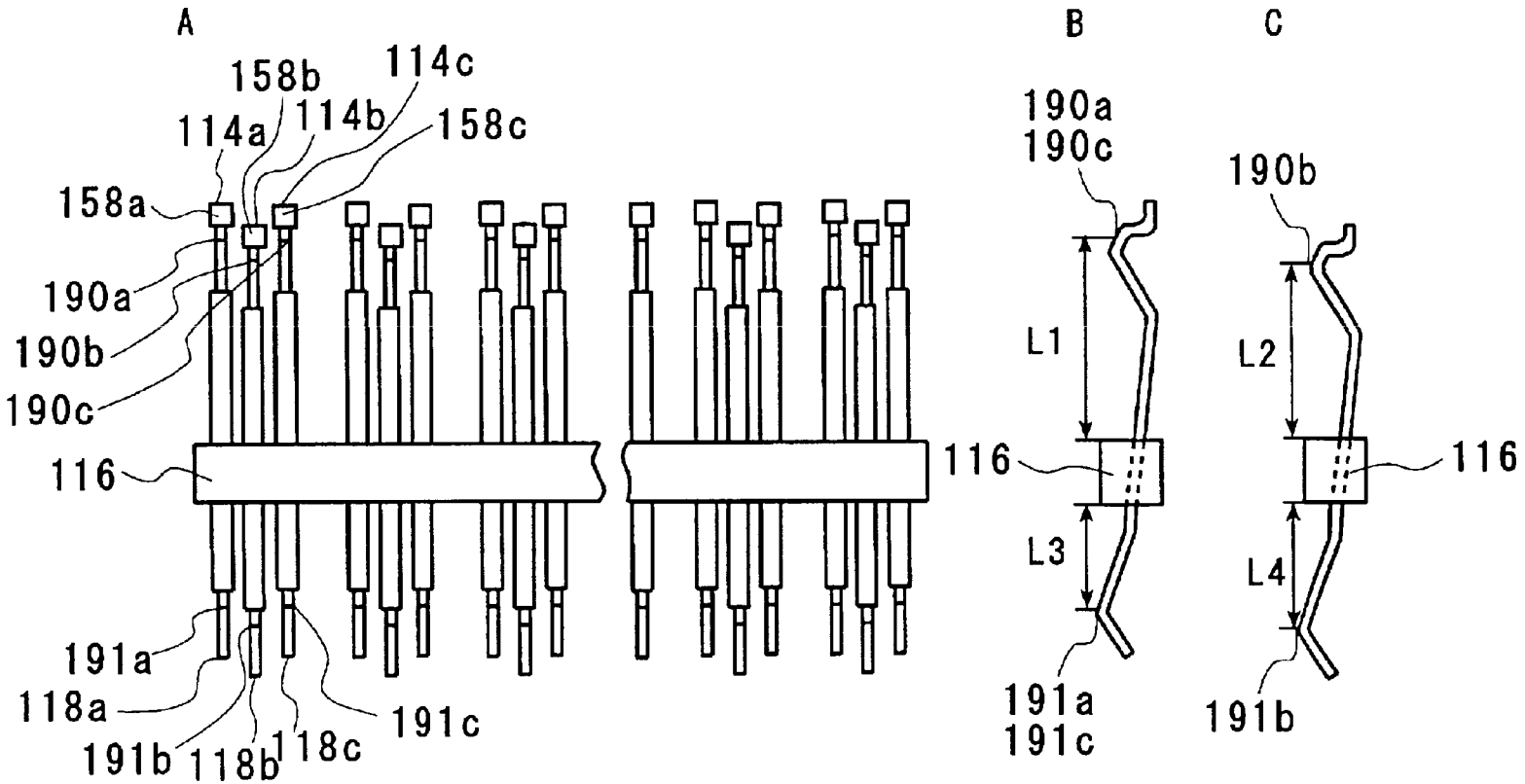
FIG. 6A is an enlarged front view of contacts of the module-type connector and the base component supporting the contacts.
FIGS. 6B and 6C are enlarged side cross-sectional views.

FIG. 6 shows an enlarged front view (FIG. 6A) and enlarged side cross-sectional views (FIGS. 6B, 6C) of contacts (114, 118) and base component (116) supporting the contacts. Contacts (114, 118) include contacting portions (190, 191), respectively. Three elements of each contact (114) are named contact (114*a*), contact (114*b*), and contact (114*c*) from the left of FIG. 6A, respectively, and the three elements of each contact (118) are named contact (118*a*), contact (118*b*), and contact (118*c*), respectively in the same way. Three elements of contacting portion (190) are named contacting portion (190*a*), contacting portion (190*b*), and contacting portion (190*c*) from the left of FIG. 6A, respectively, and three elements of contacting portion (191) are named contacting portion (191*a*), contacting portion (191*b*), and contacting portion (191*c*), respectively in the same way.

In contacts (114, 118) having three contact elements, contacts (114*b*, 118*b*) have a different distance measured from base component (116) from other contacts, that is, contacts (114*a*, 114*c*, 118*a*, 118*c*). Further, contacting portions (190*b*, 191*b*) also have a different distance measured from base component (116) from other contacting portions, that is, contacting portions (190*a*, 190*c*, 191*a*, 191*c*).

For example, if the distance between contacting portions (190*a*, 190*c*) and base component (116) is referred to as "L1"; if the distance between contacting portion (190*b*) and base component (116) is referred to as "L2"; if the distance between contacting portions (191*a*, 191*c*) and base component (116) is referred to as "L3"; and if the distance between contacting portion (191*b*) and base component (116) is referred to as "L4," L1 is greater than L2 and L3 is smaller than L4. Since contacts (114, 118) have the same dimension and the same configuration, L1–L2 equals L3–L4. FIG. 6 only shows contacts (114, 118) and base component (116), but contacts (115, 119) and base component (117) are alike. Base components (116, 117) are harmonizingly mounted in frame (171) of first housing (170) shown in FIG. 5. With reference to FIGS. 4 and 5, cross beams (141, 142) are shifted with respect to each other by a half pitch. Therefore, in contacts (115, 119) having three contact elements, contact (115*a*) and contact (119*a*) are opposed to contact (114*c*) and contact (118*c*), respectively. Contact (115*b*) and contact (119*b*) face the portion between each group of contacts.

Therefore, there is no contact which faces contact (115*b*) and contact (119*b*). Contact (115*c*) and contact (119*c*) face contact (114*d*) and contact (118*d*) of the contact group that is adjacent to a group of contacts that are comprised of contacts (114*a*, 114*b*, 114*c*) and contacts (118*a*, 118*b*, 118*c*).

Figure 7:
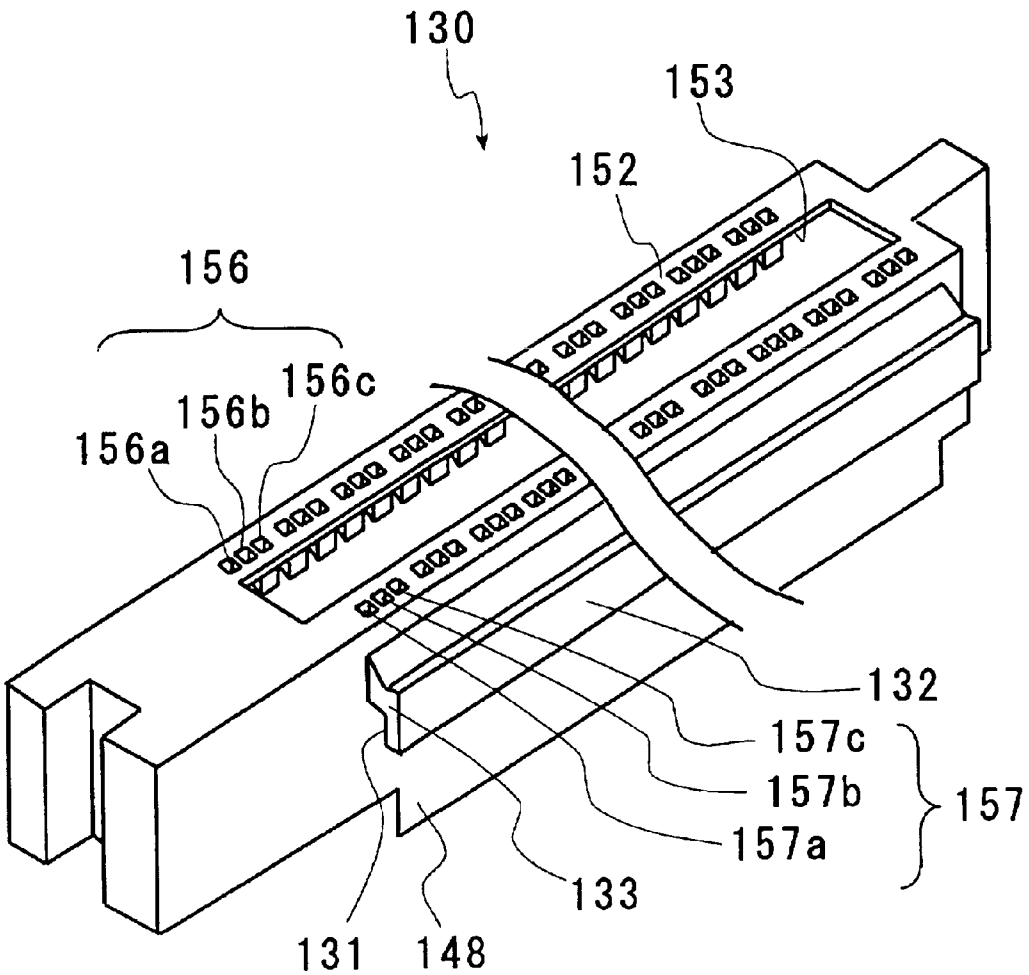
FIG. 7 is an enlarged perspective view of a second housing.

FIG. 7 is an enlarged perspective view of second housing (130). The contacts and base components (116, 117) of FIG. 4 pass the second end side of the contact in the first housing of FIG. 5 and receive base components (116, 117). Second housing (130) is covered from the first end side of their contacts and engagement piece (147, 148) (see FIG. 3) is received in recess portions (145, 146) which are formed in both lateral sides of first housing (170) and are engaged with each other. First housing (170) and second housing (130) are fastened to each other by, for example, a screw.

Insertion opening (153) where the male portion of the corresponding male connector is inserted is formed in upper surface (152) of the second housing. Along both sides of insertion opening (153), engagement small holes (156, 157) are arranged and formed in upper surface (152). Engagement small hole (156) and engagement small hole (157) are comprised of three engagement small holes (156*a*, 156*b*, 156*c*) and three engagement small holes (157*a*, 157*b*, 157*c*), as one group, respectively. End portions (158*a*, 158*b*, 158*c*) (See FIG. 6) of the first end sides of contacts (114*a*, 114*b*, 114*c*) are inserted into engagement small holes (156*a*, 156*b*, 156*c*), respectively. End portions (158*a*, 158*b*, 158*c*) make contact with the inner peripheral surface of insertion opening (153) of each engagement small hole, and thereby load is applied to contacts (114*a*, 114*b*, 114*c*) in advance in the direction of each insertion opening (153).

It is considered that the insertion force is reduced by use of deflection members. However, according to this technique, the width of the related deflection members should be greater than that of the prior arts in order to sufficiently reduce necessary insertion force for the increase of number of contacts and thus, there is a problem that bad contact occurs. Further, the insertion force can be reduced by making elastic modulus constant or spring constant of contacts small, but there is also a problem that bad contact occurs since contacting pressure reduces. However, according to the present embodiment, since end portion (158) of the first end side of contact (114) is engaged with engagement small hole (156), obtained is a female connector wherein additional members are not necessary; wherein sufficient insertion force is sufficiently reduced while maintaining appropriate contacting pressure; and wherein manufacturing is easy.

Figure 8:
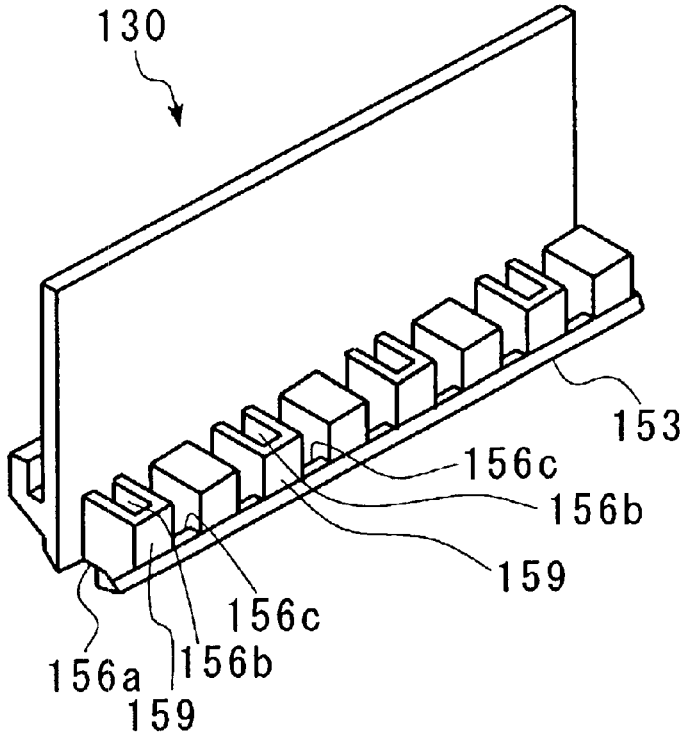
FIG. 8 shows the inside of the engagement small hole with removing a portion of the second housing.

FIG. 8 shows an inner side of engagement small hole (156) with a portion of the second housing being removed. Since the distance between contact (114*b*) and base component (116) is smaller than the distance between contact (114*a*, 114*c*) and the base component (see FIG. 6), engagement small hole (156*b*) to which contact (114*b*) is inserted has rectangular barrel portion (159) formed from the inner surface thereof. End portion (158*b*) of contact (114*b*) is engaged with rectangular barrel portion (159).

Engagement small hole (156) does not have to have a form of a hole, and may have other forms if end portion (158) can be engaged therewith, for example, the small hole may have a different level provided therein. Also, rectangular barrel portion (159) may have a different level provided therein with which end portion (158*b*) of contact (114*b*) can be engaged. In the same way, the end portions of the first end side of contacts (115*a*, 115*b*, 115*c*) are inserted into engagement small hole (157) and contact with insertion opening (153), and thereby load is applied to contacts (115*a*, 115*b*, 115*c*) in advance in the direction of insertion opening (153), respectively. Each contacting portion of contact (114, 115) protrudes so as to face each other and contacts with the contacts of the corresponding male connector with sufficient contacting pressure when the corresponding male connector is inserted.

Figure 9:
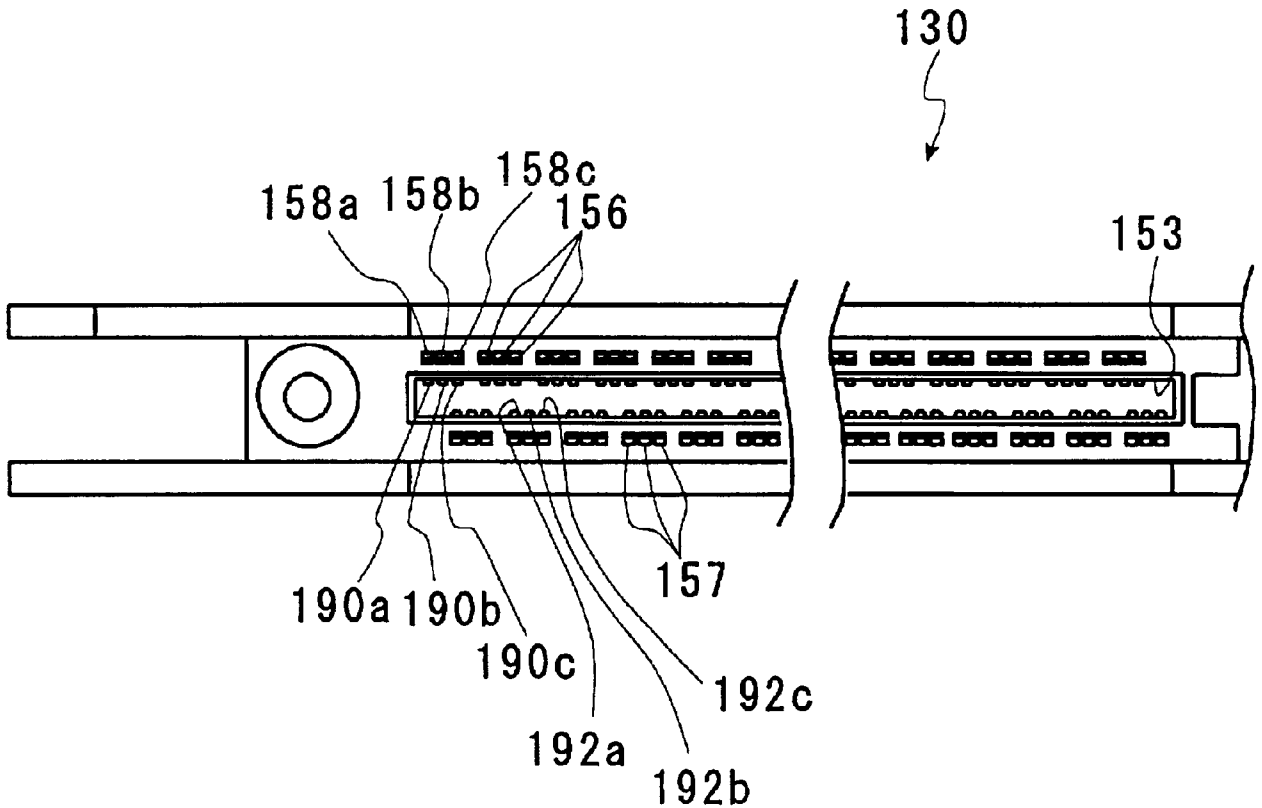
FIG. 9 is a plan view of the second housing in the state where the contacts of the module-type connector are engaged with an engagement small hole.

FIG. 9 is a plan view of second housing (130) in the state where contacts (114, 115) engage with engagement small hole (156, 157). The portions of contacts (114, 115) which protrude so as to face each other (that is, contacting portions) are seen from insertion opening (153).

The engagement of contacts (114, 115) with engagement small hole (156, 157) is accomplished by covering second housing (130) from the first end side of contacts (114, 115) in base component (116, 117) when the gap between contact (114) and contact (115) is widened by a jig having nearly the same configuration and the same cross-sectional shape as opening (153) and thereafter by removing the jig after each contact is inserted into the corresponding small hole. Second housing (130) is mounted in first housing (170) and thereby housing (120) is assembled.

As shown in FIG. 3 or FIG. 7, projection portion (132) is formed in the lateral sides of the second housing along the lengthwise direction and thereby fitting groove (131) is formed. A portion of rigid supporting plates (150, 151) is received in fitting groove (131). Housing (120) is interposed between rigid supporting plates (150, 151) and is fixed therebetween by a screw. Particularly, it is noted that engagement pieces (147, 148) enter between rigid supporting plates (150, 151) and are positioned between fitting recess portions (145, 146) of the first housing and rigid supporting plates (150, 151); and that projecting portion (132) is positioned so as to press fit edge end portions of rigid supporting plates (150, 151). In this way, a module-type connector in which a plurality of housings (120) are joined along the longitudinal direction is strengthened.

Figures 10A, 10B:
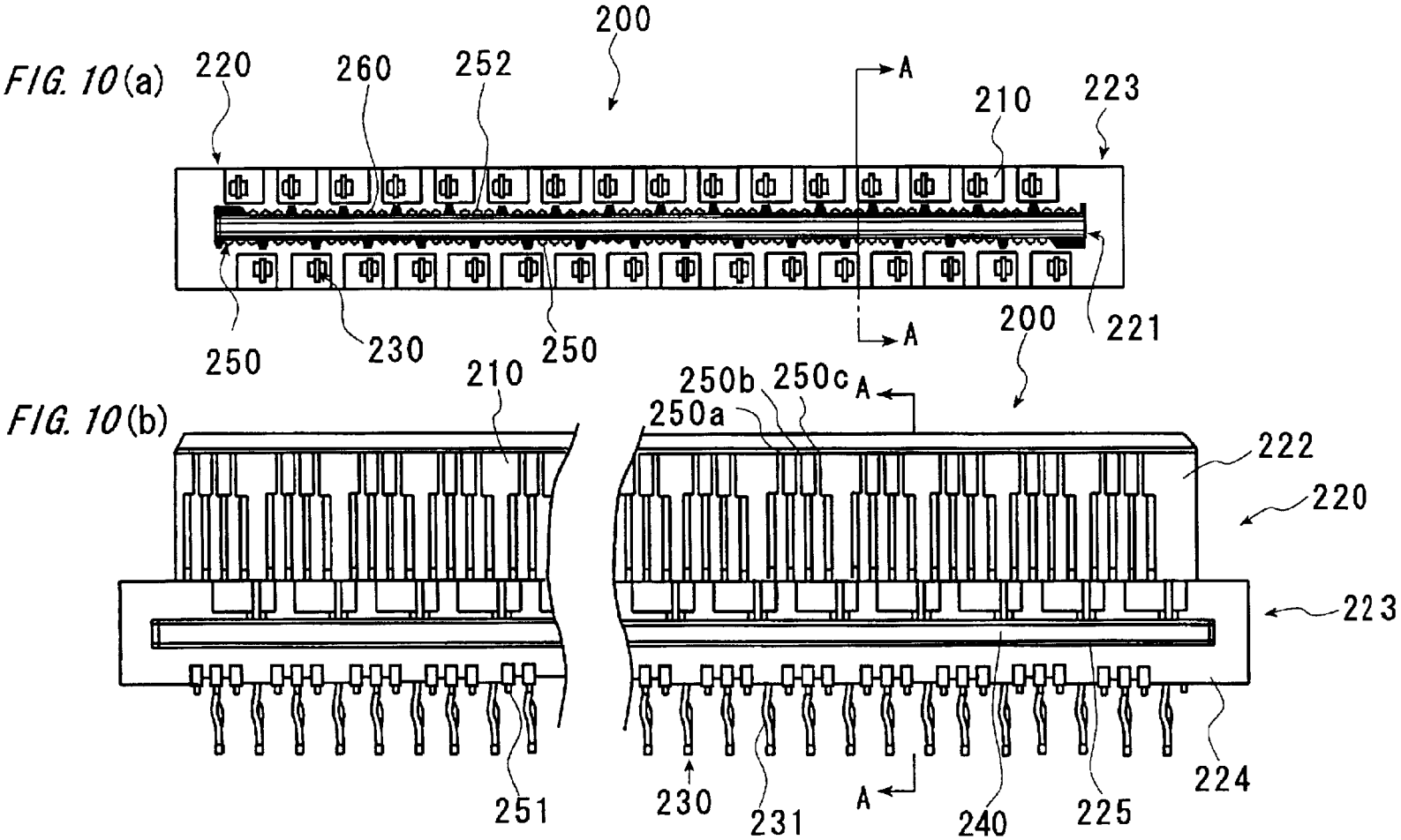
FIG. 10 shows the male connector according to the present invention.
Figure 11:
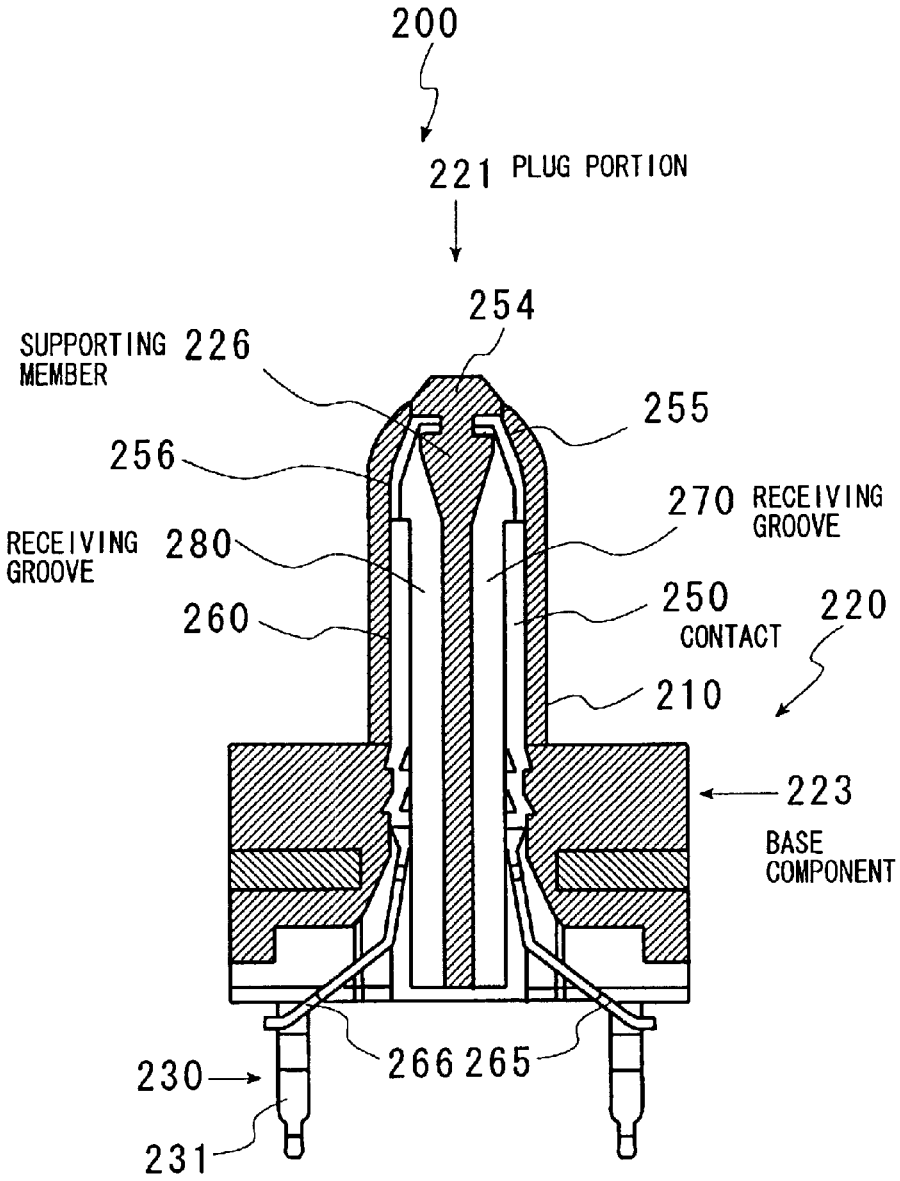
FIG. 11 shows the inside structure of the male connector.

FIG. 10 shows a male connector according to the present embodiment. FIG. 10*a* is a plan view and FIG. 10*b* is a front view. FIG. 11 is a cross-sectional view of the male connector of FIG. 10, which is taken along line A—A in FIG. 10.

FIG. 10 shows a male connector. Male connector (200) is mounted on a circuit board (not shown). Plug portion (221) of male connector (200) is fitted to a female connector (See FIG. 2.) that is mounted on the other circuit board, and thereby the circuit boards are connected to each other. For example, plug portion (221) is inserted into connector component (110) and the contacting portions which are provided in the connectors contact with each other, thereby connecting each other electrically.

Plug connector (200) has a slender supporting member (226) that is integrally formed with plug portion (221) and base component (223) (See FIG. 11.); contact (250) that is arranged and mounted in supporting member (226) along the lengthwise direction; and fastening member (230) for fastening supporting member (226) in a circuit board. Fastening member (230) has a compliance portion (231) and male connector (200) can be securely fastened with respect to the circuit board by engaging compliance portion (231) with the through-hole that is formed in the circuit board. Fastening member receiving groove (225) of fastening member (230) is formed in the lateral sides (224) of base component (223). Plate (240) is received within fastening member receiving groove (225) and supporting member (226) is strengthened. Contact (250) is arranged three by three so that the backside conforms to both lateral sides (222) of plug portion (221), and has board contacting portion (265, 266) for elastically contacting with the circuit board and contacting portion (252) that is arranged along both lateral sides (222) of plug portion (221).

In both lateral sides (222) of plug portion (221) of supporting member (226), protruding portion (210) is provided between contact groups (250) that have three contact elements arranged. Preferably, protruding portion (210) is formed integrally with plug portion (221), that is, supporting member (226). Protruding member (210) will be described in the following.

FIG. 11 shows the inner structure of male connector (200) in detail. Contact (250) is fixed by supporting member (226). In housing (220), base component (223) and plug portion (221) that extends in the center of a surface of the base component along the lengthwise direction are formed integrally with each other. In the lateral sides of plug portion (221), contact receiving grooves (270, 280) are formed and the grooves (270, 280) pass through base component (223). Contacts (250, 260) are received in each receiving groove (270, 280) and are fixed by engaging with base component (223).

Figure 12:
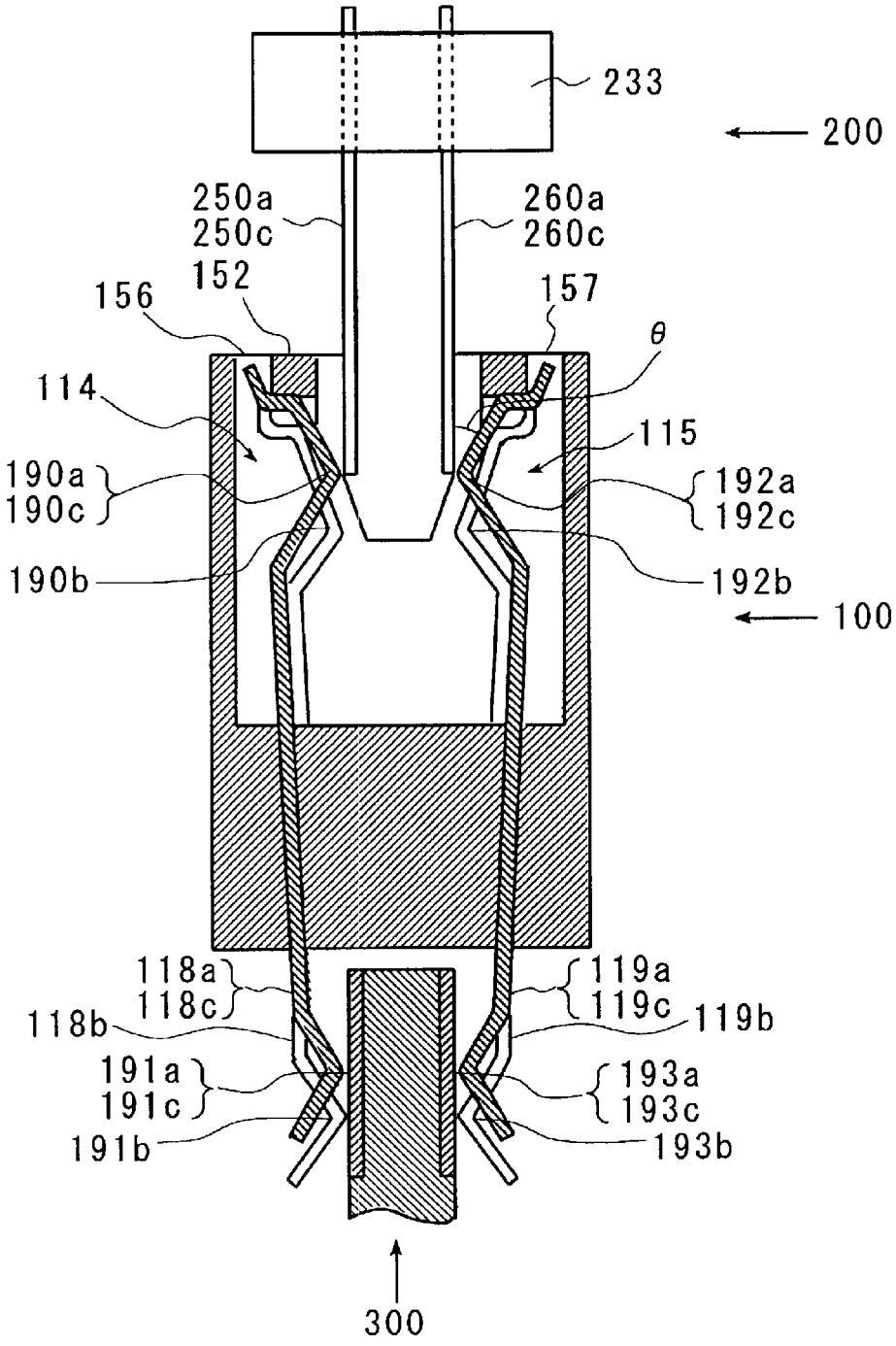
FIG. 12 shows a configuration wherein the male connector is fitted to the female connector and is fitted to the circuit board.

FIG. 12 shows a configuration wherein male connector (200) is engaged with female connector (100) and is fitted in circuit board (300).

When male connector (223) is inserted into connector component (110) from insertion opening (153) of female connector (100) (See FIG. 9.), contacts (250*a*, 250*c*, 260*a*, 260*c*) of male connector (200) contact with contacts (114*a*, 114*c*, 115*a*, 115*c*) respectively, and the gaps between contacts (114*a*, 114*c*) and contacts (115*a*, 115*c*) are extended. Thereafter, contacting portions (190*a*, 190*c*, 192*a*, 192*c*) of female connector (100) contact with the contacting portions (portions perpendicular to base component (223)) of contacts (250*a*, 250*c*, 260*a*, 260*c*) of male connector (200), respectively. In this state, the gaps between contacts (114*a*, 114*c*) of female connector (100) and contacts (115*a*, 115*c*) are fully extended. Thereafter, contacts (250*b*, 260*b*) of male connector (200) contact with contacts (114*b*, 115*b*) of female connector (100), respectively, and the gap between contact (114*b*) and contact (115*b*) is extended. In the state where plug portion (221) of the male connector is sufficiently inserted into connector component (110) from insertion opening (153) of female connector (100), contacting portions (190*b*, 192*b*) of contacts (114*b*, 115*b*) of female connector (100) contact with the contacting portions of contacts (250*b*, 260*b*) of the male connector, respectively.

In FIG. 12, the height of contacting portions (190*a*, 190*c*, 192*a*, 192*c*) of female connector (100) with respect to the base component is "L1," and the height of contacting portions (190*b*, 192*b*) with respect to the base component is "L2." Thereby, at the beginning of the male connector fitting, ⅔ of all contacts are extended, and thereafter, the remaining ⅓ are extended. Thus, comparing with the prior art wherein all contacts are extended at the same time, the insertion force is distributed at two times. At the beginning, ⅔ of insertion force is necessary and thereafter, ⅓ of insertion force is necessary.

Further, in the present embodiment, the end portions of the first end side of contacts (114, 115) of female connector (100) engage with engagement small holes (156, 157) that are provided in upper surface (152) of housing (120). A preliminary load is applied so that the gap between contacts (114, 115) becomes larger. Even if the displacement of contacting portions (190, 192) of contacts (114, 115) of female connector (100), which is generated by the insertion of the male connector, is small, it is possible to maintain the contacting pressure with contacts (250, 260) of male connector (200) as being sufficiently high. That is, it is possible to make contacting angle θ smaller since displacement of contacting portions (190, 192) may be smaller than the prior art for obtaining the same contacting pressure. In this way, since the tangential direction of contacting between male connector (200) and female connector (100) approaches parallel with the insertion direction from the very first time of the insertion of male connector (200), the insertion force can be reduced.

Figure 13:
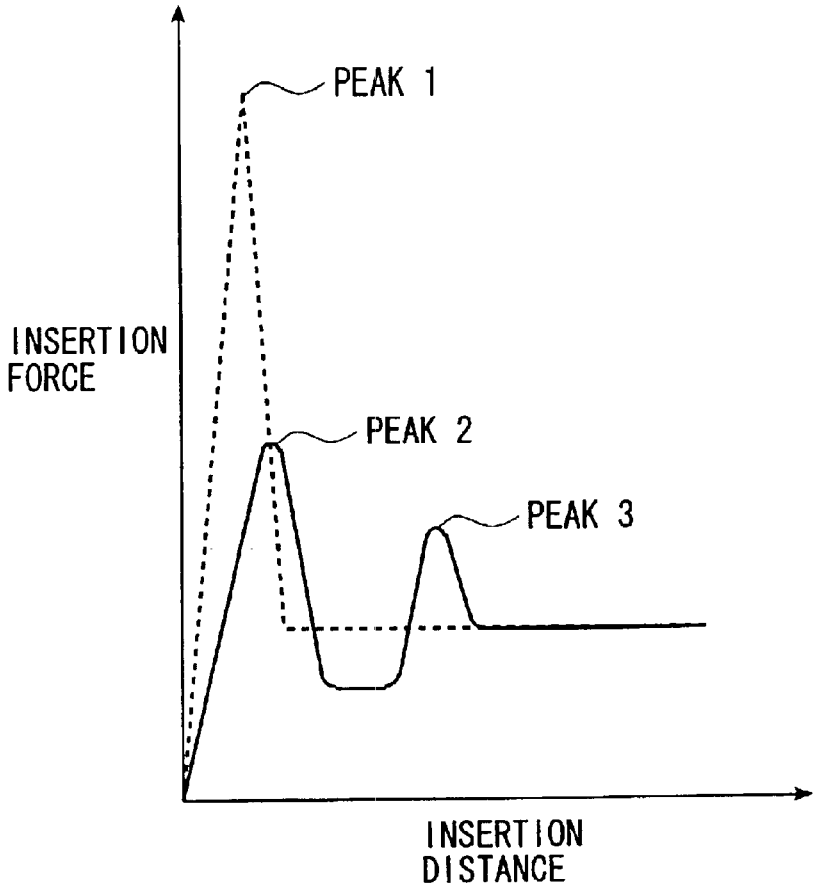
FIG. 13 is a graph showing the relation between insertion force and insertion distance.

FIG. 13 is a schematic graph showing the relationship between the insertion force and the insertion distance. The vertical axis shows the insertion force between male connector (200) and female connector (100) and the abscissa shows their insertion distance. The origin indicates the state of the very first time of contact (insertion).

In the present embodiment, as indicated by a solid line, peak value (1) is obtained when contacting portions (190*a*, 190*c*, 192*a*, 192*c*) of female connector (100) are extended. Thereafter, the insertion force is reduced once in the state where contacting portions (190*a*, 190*c*, 192*a*, 192*c*) are fully extended, and thereafter, peak value (2) is obtained when contacting portions (190*b*, 192*b*) are extended.

The broken line indicates the prior art. In order to extend the contacting portions of all contacts, the insertion force of very large peak value (3) is necessary.

The above description can be applied to when circuit board (300) is inserted to female connector (100) as shown in the below FIG. 12, as well as the relation between male connector (200) and female connector (100). That is, contacts (118*a*, 118*c*, 119*a*, 119*c*) and contacts (118*b*, 119*b*) are shifted in the direction along which the circuit board is inserted. Accordingly, contacting portions (191*a*, 191*c*, 193*a*, 193*c*) and contacting portions (191*b*, 193*b*) shift in the insertion direction of the circuit board. Thereby, the insertion force is reduced since the insertion force is distributed when contacting portions (191*a*, 191*c*, 193*a*, 193*c*) are extended and when contacting portions (191*b*, 193*b*) are extended.

Further, it is also possible that each of the contacts of female connector (100), which have three contacting elements, has an alternatively different distance from the base component from one another. The insertion force can be further reduced by setting the distance of three or more stages without limiting the distance of two stages. However, in any cases, along the lengthwise direction, it is necessary to make the contacts having the contacting portions having the same distance from the base component almost uniform in the same direction so that the insertion force differs along the lengthwise direction of the connector.

The insertion force also can be reduced by applying load in advance so that, while maintaining the distance between the contacting portions of the contacts and the base component as being uniform, the gap between the contacting portions of the contacts facing them increases, or inversely by making the distance between the contacting portions and the base component nearly uniformly different. According to the aforesaid description, the housing of the female connector has a plurality of members. The housing can be formed as one structure. Further, the second end side of the housing of female connector (100) can be surface mounted.

With reference to FIG. 10, three contacts (250) are arranged in both lateral sides (222) of plug portion (221) of supporting member (226) as one group of contacts. Protruding portion (210) is provided between the groups of contacts (250). Protruding portion (210) also projects from the contacting surface of contacts (250, 260) in the lengthwise direction of male connector (200).

Protruding portion (210) prevents contacts (250, 260) of male connector (200) from directly making contact with housing (220) of female connector (100) when male connector (200) is inserted into female connector (100). Recently, the number of necessary contacts has increased. In the field of electrical device, arranging many connector assemblies along their crosswise direction and connecting many conductors has coped with this situation. In this structure, male and female connectors that are fitted to each other collide with each other and the possibility that wrong connectors are fitted to each other increases. For example, in the IC test device, many circuit boards where a female connector is mounted are arranged in crosswise direction within the device. A guide pin is provided horizontally in the device body and hole (101) (See FIG. 1.) and is provided in the female connector in advance. The guide pin is inserted to hole (101) of the female connector and the board is arranged and enters the device body. The circuit board and the female connector are fixed with respect to the device. On the other hand, the male connector is fixed in a motherboard, a performance board, an interface board and so forth. Generally, it is difficult to accurately locate the board attached to the male connector in the related position when the board moves to the fitting position of the female connector. If the positional shift is severe, the collision between male connectors and female connectors within the device and mis-insertion occurs. Further, the contacting portions of the male connecter cut the insulate housing of the female connector by the collision or making contact with both connectors. Particles such as debris generated by the cutting enter the contacting portion and thereby cause bad contact. Cutting of insulating housing of the female connector can be prevented by providing protruding portion (210) in the male connector.

In the following, the operation of the present invention will be described. When a male connector and a female connector are fitted to each other, it is preferred that fitting starts from the state where both connectors are pulled and separated in a distance while maintaining the relative position of lengthwise direction and crosswise direction of both connectors after fitting (The position is referred to as "center position," hereinafter.). However, generally, both connectors are relatively shifted from the center position in lengthwise direction or crosswise direction. In the structure, if both connectors are fitted to each other, a portion of a plug portion of a male connector makes contact with the housing of a female connector. In the prior art, a portion of the plug portion of the male connector is supporting member or contact. Generally, the housing is made of resin softer than metal and the contact is made of metal. Therefore, if the contacts of the male connector contact with the housing of the female connector, the contacts cut the housing and cutting debris and so forth are generated. If the debris and so forth enters the contacting portion of the contact, bad contact can occur.

Therefore, according to the present embodiment, protruding portion (210) is formed so as to project from the contacting surface of contacts (250, 260) in the crosswise direction of male connector (200), thereby preventing contacts (250, 260) from directly making contact with housing (120) of female connector (100). Protruding portion (210) is provided, and thereby the protruding portion can contact with the housing (120). Therefore, it is preferred that protruding portion (210) is made of the same material as housing (120), or it may be made from material having the same softness as the housing or having higher softness than the housing.

FIG. 11 shows the configuration wherein protruding portion (210) protrudes. That is, protruding portion (210) is seen in the inner position than contacts (250, 260) with respect to the drawing. Protruding portion (210) extends to both sides of supporting member (226) through base component (223) from leading end (254) of plug portion (221) of housing (220) of the male connector. The height at which protruding portion (210) projects from supporting member (226), that is, the height of the protrusion is not specified. However, it is necessary that at least plug portion (221) of contacts (250, 260) is higher than contacting surface (255, 256); it is preferred that protruding portion (210) near leading end portion (254) of plug portion (221) has the configuration so as to reduce insertion force when it is fitted to the corresponding connector. In this embodiment, the configuration of protruding portion (210) has roughly a bullet shape in the cross-sectional view when viewed in the crosswise direction.

Figure 14:
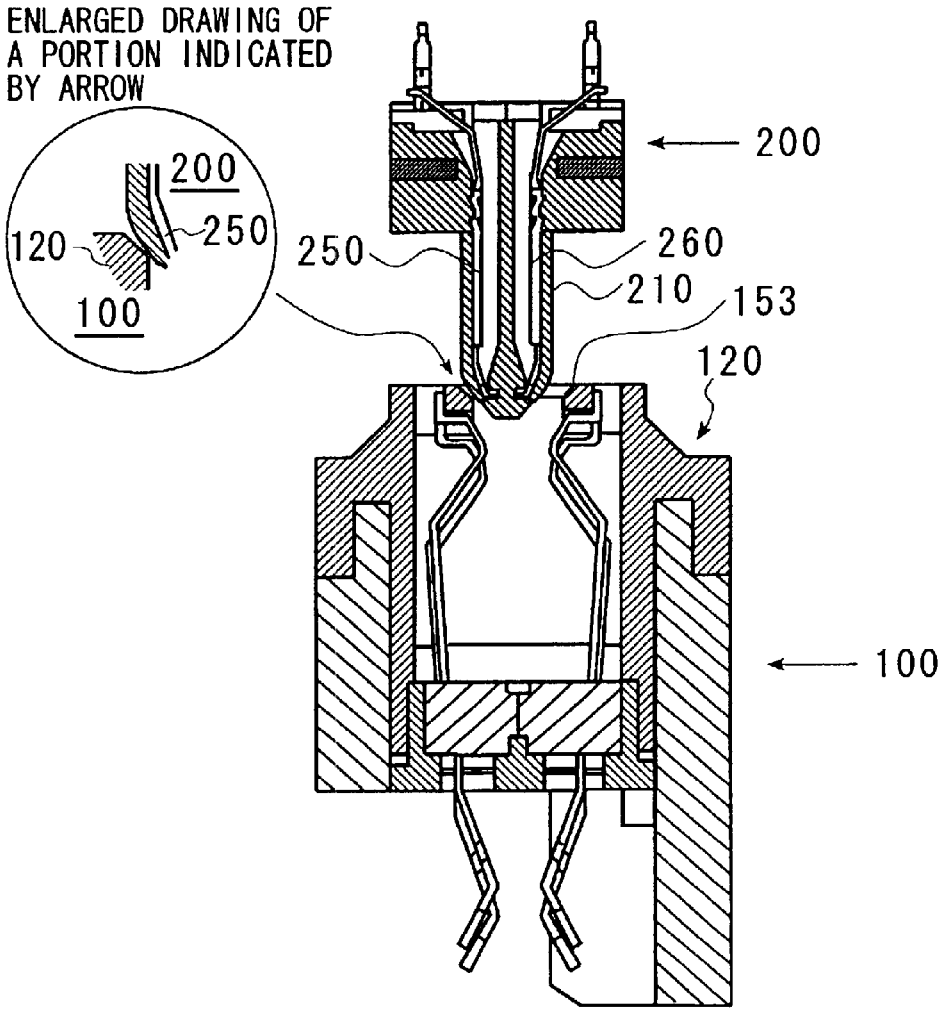
FIG. 14 shows a configuration wherein a male connector having a protruding portion is inserted into the insertion opening of a female connector.

FIG. 14 shows the configuration wherein male connector (200) having protruding portion (210) is inserted into insertion opening (153) of female connector (100). Even when fitting starts when both connectors are relatively shifted from the center position, contacts (250, 260) of male connector (200) do not contact housing (120) although protruding portion (210) makes contact with housing (120). Thus, it is prevented to generate particles caused by making contacts (250, 260) with housing (120).

Figure 15:
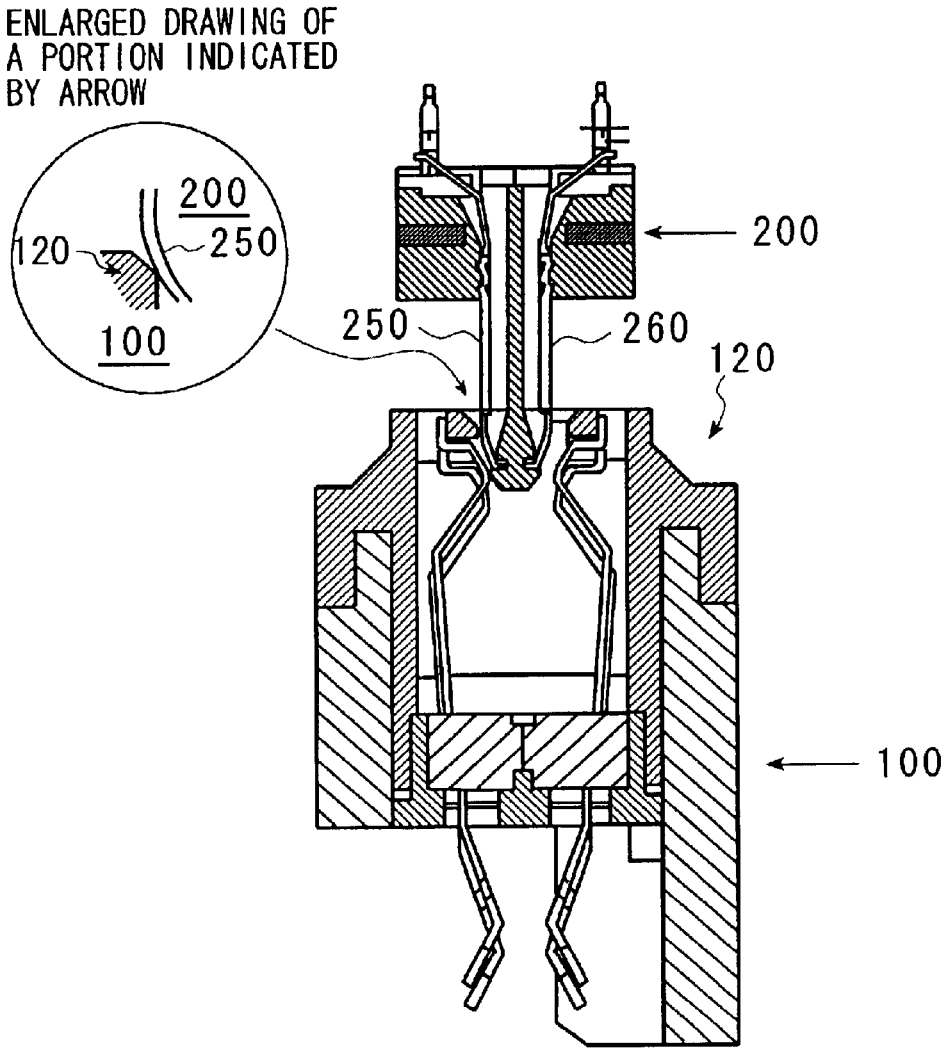
FIG. 15 shows the fitting of the conventional male connector.

FIG. 15 shows the configuration wherein the male connector of the prior art is fitted. Comparing with FIG. 14, it is understood that the contacting portion of the male connector makes contact with the housing. (See the portion indicated by an arrow.)

As clearly understood from the above, according to the present invention, movement of the contacts so as to open is prevented and that lengthwise error generates even if the number of connections increases since the housing is fixed by the rigid supporting plates and the generation of bad contact is prevented since the contacts are shifted.

Further, the insertion force of the male connector and the circuit board can be reduced since the elastic contacting portions of the contacts of the module-type connector that are shifted in the separation direction of the contacting corresponding connectors are almost uniformly distributed.

The ends of the contacts are contacted with pressure in the inner circumferential surface of the insertion opening of each engagement small hole of the housing and a preliminary load is applied to the contacts. In this way, the insertion force of the male connector can be further reduced.

It is impossible that the contacts of the male connector directly collide or make contact with the housing of the corresponding connector due to a protruding portion that is provided between a predetermined contact of the male connector and the contact adjacent to the predetermined contact and that protrudes from the contacting surface of the contacts in an outward direction.

It should be noted that the scope of the present invention is not limited to the described embodiments. That various modification or improvements to the described embodiments are possible is clearly understood to a person skilled in the art. It is clear from the claims that the modification and improvements also fall within the scope of the present invention.

In the above, according to the present invention, it is easy to properly fit a male connector and a female connector.

Although the present invention has been described by way of exemplary embodiments, it should be understood that many changes and substitutions may be made by those skilled in the art without departing from the spirit and the scope of the present invention which is defined only by the appended claims.

What is claimed is:

1. A modular connector assembly, comprising:

a plurality of connectors which have a plurality of contacts having contacting portions contacting with a plurality of corresponding terminals and a housing which holds said plurality of contacts;

a rigid supporting plate fixing the plurality of connectors that are serially arranged in a lengthwise direction, and a plurality of the rigid supporting plates which fix the plurality of connectors by interposing each of the plurality of connectors therebetween, wherein said housing comprises insulating material and said rigid supporting plate comprises metal, wherein at least one of said plurality of connectors has a protruding portion at an end in the lengthwise direction;

wherein at least another one of said plurality of connectors has a recess portion at an end in the lengthwise direction;

wherein the plurality of connectors are fixed by interposing a fitting portion, where said protruding portion and said recess portion are fitted to each other, between the plurality of rigid supporting plates and by said fastener penetrating the rigid supporting plate and the fitting portion and fastening the rigid supporting plate and the fitting portion.

2. The modular connector assembly according to claim 1, wherein each of said plurality of connectors has a fastener defining position of said plurality of connectors with respect to said rigid supporting plates by fastening said rigid supporting plate with the plurality of connectors.

3. The modular connector assembly according to claim 1, wherein the rigid supporting plate has a groove or opening in a predetermined position and the plurality of connectors have protrusions and wherein the position of the plurality of connectors with respect to the rigid supporting plate is defined by fitting the protrusion to the groove or the opening.

4. The modular connector assembly according to claim 1, wherein the rigid supporting plate has a form of box, and wherein the position of each of the plurality of connectors with respect to the rigid supporting plate is defined by having the plurality of connectors received therein.

5. A connector having a plurality of contacts having contacting portions contacting with corresponding terminals and first end portions, wherein the plurality of first end portions are shifted in an insertion direction of the corresponding terminals, and wherein the contacting portions of the plurality of contacts are shifted in the insertion direction of the corresponding terminals, wherein the contacts have a second end portion that is provided in the opposing side of the first end portion and a second contacting portion that is provided in the side of the second end portion, and wherein the second contacting portion is shifted in the insertion direction of the corresponding terminal.

6. The connector according to claim 5, wherein the plurality of contacts are disposed so as to oppose one another, and wherein the connector further has a housing having an engagement portion that engages the first end portion of each of the contacts in the different position with respect to the insertion direction of at least one of the plurality of corresponding terminals in order to widen the gap between the contacting portions of the plurality of contacts which oppose one another.

7. The connector according to claim 5, wherein the plurality of second end portions are shifted in the insertion direction of the corresponding terminals and wherein the difference in the insertion direction between the level of the first end portion of a predetermined contact and the level of the first end portion of the contact adjacent to the predetermined contact is substantially the same as the difference in the insertion direction between the level of the second end portion of the predetermined contact and the level of the second end portion of the contact adjacent to the predetermined contact.

8. A connector comprising a plurality of contacts having contacting portions contacting with a plurality of corresponding terminals and a supporting member supporting the plurality of contacts, the connector further comprises a protruding portion that is provided between a predetermined contact of the plurality of contacts and the contact adjacent to the predetermined contact and that protrudes from contacting surface of the plurality of contacts and contacts one of the plurality of corresponding terminals, wherein said protruding portion is made of a material that is softer than material of the housing holding the plurality of corresponding terminals.

9. The connector according to claim 8, wherein the gap between the plurality of contacts and the supporting member exists in the cross-sectional view in a direction perpendicular to the arranging direction of the plurality of contacts.

10. The connector according to claim 8, wherein the plurality of contacts are arranged back to back on both sides of the supporting member and wherein each of the plurality of contacts while moving in the insertion direction of the connector, bends toward the supporting member.

11. A connecter for insertion into a corresponding terminal comprising:

a base component;

a support member extending from the base component and having a leading end portion;

a contact adapted to contact a corresponding contact of the corresponding terminal, the contact extending from the base component and terminating at a first location on the leading end portion of the support member; and a protruding member disposed adjacent the contact, the protruding member extending from the base component and terminating at a second location on the leading end portion of the support member;

wherein the second location is located distal to the first location.

12. The connector according to claim 11, wherein the plurality of contacts are arranged back to back on both sides of the supporting member and wherein each of the plurality of contacts, while moving in the insertion direction of the connector, bends toward the supporting member.

* * * * *